US011591833B2

(12) United States Patent
Naylor

(10) Patent No.: US 11,591,833 B2
(45) Date of Patent: Feb. 28, 2023

(54) THROW LOCK ASSEMBLIES, THROW BOLT ASSEMBLIES, AND METHODS FOR ASSEMBLING AND USING SAME

(71) Applicant: BJA Trading Ltd, Buckinghamshire (GB)

(72) Inventor: Mark Anthony Naylor, Cheshire (GB)

(73) Assignee: BJA Trading Ltd

( * ) Notice: Subject to any disclaimer, the term of this patent is extended or adjusted under 35 U.S.C. 154(b) by 671 days.

(21) Appl. No.: 16/482,621

(22) PCT Filed: Jan. 29, 2018

(86) PCT No.: PCT/EP2018/052145
§ 371 (c)(1),
(2) Date: Jul. 31, 2019

(87) PCT Pub. No.: WO2018/141692
PCT Pub. Date: Aug. 9, 2018

(65) Prior Publication Data

US 2020/0024877 A1 Jan. 23, 2020

(30) Foreign Application Priority Data

Jan. 31, 2017 (GB) ..... 1701547

(51) Int. Cl.
*E05C 1/02* (2006.01)
*E05B 15/02* (2006.01)
(Continued)

(52) U.S. Cl.
CPC ..... *E05C 1/02* (2013.01); *E05B 15/022* (2013.01); *E05B 15/1621* (2013.01);
(Continued)

(58) Field of Classification Search
CPC ..... E05B 63/0017; E05B 17/042; E05B 15/1621; E05B 15/022; E05B 15/0205;
(Continued)

(56) References Cited

U.S. PATENT DOCUMENTS 2,290,727 A * 7/1942 Best ..... E05B 55/12 292/172
2,873,989 A 2/1959 Stone et al.
(Continued)

FOREIGN PATENT DOCUMENTS

AU 2002100150 A4 5/2002
CA 2133050 A1 3/1996
(Continued)

OTHER PUBLICATIONS

International Search Report dated May 18, 2018 in connection with International Patent Application No. PCT/EP2018/052152, 3 pages.
(Continued)

*Primary Examiner* — Christine M Mills
*Assistant Examiner* — Faria F Ahmad

(57) ABSTRACT

A lock assembly comprising a throw bolt, a bolt holder and a bolt keeper. The bolt comprises a cutting barrier and a bolt casing, the bolt casing being more corrosion-resistant than the cutting barrier, and the cutting barrier being more abrasion-resistant that the bolt casing. When assembled, the cutting barrier will be enclosed within the bolt casing.

20 Claims, 11 Drawing Sheets

(51) Int. Cl.

| | |
|---|---|
| ***E05B 15/16*** | (2006.01) |
| ***E05B 17/04*** | (2006.01) |
| ***E05B 63/00*** | (2006.01) |
| ***E05B 65/00*** | (2006.01) |
| *E05C 9/02* | (2006.01) |
| *E05C 7/00* | (2006.01) |
| *E05C 9/04* | (2006.01) |
| *E05C 17/30* | (2006.01) |
| *E05B 63/06* | (2006.01) |

(52) U.S. Cl.
CPC ..... *E05B 15/1635* (2013.01); *E05B 17/042* (2013.01); *E05B 63/0017* (2013.01); *E05B 65/0007* (2013.01); *E05B 63/06* (2013.01); *E05C 7/00* (2013.01); *E05C 9/021* (2013.01); *E05C 9/041* (2013.01); *E05C 17/30* (2013.01); *Y10T 292/696* (2015.04)

(58) Field of Classification Search
CPC .. E05B 15/1635; E05B 15/16; E05B 65/0007; E05B 85/22; E05B 17/0004; E05B 63/06; E05C 1/02; E05C 1/002; E05C 1/004; E05C 9/021; E05C 9/041; E05C 7/00; E05C 17/30; E05C 292/23; Y10S 292/64; Y10T 22/6969; Y10T 292/06; Y10T 292/62
See application file for complete search history.

(56) References Cited

U.S. PATENT DOCUMENTS

| | | | | | |
|---|---|---|---|---|---|
| 4,552,392 | A | | 11/1985 | Morello | |
| 4,633,688 | A | * | 1/1987 | Beudat | E05B 47/0012 292/142 |
| 4,752,090 | A | * | 6/1988 | Lin | E05B 63/06 292/DIG. 60 |
| 4,772,055 | A | * | 9/1988 | Fang | E05B 63/06 292/DIG. 60 |
| 4,979,768 | A | * | 12/1990 | Marotto | E05B 63/06 292/1.5 |
| 5,152,558 | A | | 10/1992 | Smith et al. | |
| 5,280,973 | A | | 1/1994 | Culling | |
| 5,364,138 | A | * | 11/1994 | Dietrich | E05B 63/06 292/1.5 |
| 5,456,503 | A | * | 10/1995 | Russell, IV | E05B 63/06 292/DIG. 60 |
| 5,551,264 | A | * | 9/1996 | Fann | E05B 9/02 292/1.5 |
| 5,562,314 | A | * | 10/1996 | Wheatland | E05B 63/06 292/1.5 |
| 5,957,510 | A | * | 9/1999 | Kuo | E05B 63/06 292/DIG. 60 |
| 6,688,660 | B2 | * | 2/2004 | Huang | E05B 63/06 292/DIG. 60 |
| 6,764,112 | B2 | * | 7/2004 | Lan-Shi | E05B 63/06 292/1.5 |
| 7,695,032 | B2 | * | 4/2010 | Bodily | E05C 1/163 292/DIG. 60 |
| 8,001,813 | B1 | * | 8/2011 | Turnbo | E05B 63/0017 70/134 |
| 2005/0160775 | A1 | | 7/2005 | Evans | |
| 2007/0052245 | A1 | | 3/2007 | Bodily et al. | |
| 2007/0200356 | A1 | | 8/2007 | Thornton et al. | |
| 2009/0071209 | A1 | * | 3/2009 | Lurie | E05B 63/0017 70/391 |
| 2015/0337574 | A1 | | 11/2015 | Speckamp | |

FOREIGN PATENT DOCUMENTS

| | | | | | |
|---|---|---|---|---|---|
| DE | 2263702 | A1 | | 7/1974 | |
| DE | 10216718 | A1 | | 10/2003 | |
| EP | 1113127 | A1 | | 7/2001 | |
| FR | 404777 | A | | 12/1909 | |
| FR | 574792 | | | 7/1924 | |
| FR | 2191587 | A5 | | 2/1974 | |
| GB | 1135192 | A | | 12/1968 | |
| GB | 2158501 | A | * | 11/1985 | E05B 67/36 |
| JP | 2005016093 | A | | 1/2005 | |
| JP | 2010024767 | A | | 2/2010 | |
| WO | 2009/125436 | A1 | | 10/2009 | |

OTHER PUBLICATIONS

Written Opinion of the International Searching Authority dated May 18, 2018 in connection with International Patent Application No. PCT/EP2018/052152, 7 pages.
Search Report dated May 24, 2017 in connection with United Kingdom Patent Application No. GB1701551.2, 2 pages.
Combined Search and Examination Report under Sections 17 & 18(3) dated May 25, 2017 in connection with United Kingdom Patent Application No. GB1701551.2, 2 pages.
Examination Report under Section 18(3) dated Feb. 27, 2020 in connection with United Kingdom Patent Application No. GB 1701551.2, 2 pages.
UK Intellectual Property Office, Combined Search and Examination Report under Section 17 & 18(3), in connection with Application No. GB 1701547.0, dated Jun. 2, 2017, 6 pages.
UK Intellectual Property Office, Examination Report under Section 18(3), in connection with Application No. GB 1701547.0, dated Aug. 28, 2019, 4 pages.
UK Intellectual Property Office, Combined Search and Examination Report under Section 17 & 18(3), in connection with Application No. GB 1902814.1, dated Aug. 28, 2019, 5 pages.
International Preliminary Report on Patentability, in connection with International Application No. PCT/EP2018/052145, dated Aug. 15, 2019, 8 pages.
ISR, International Search Report, in connection with International Application No. PCT/EP2018/052145, dated Nov. 5, 2018, 3 pages.
ISA/EP, Written Opinion of the International Searching Authority, in connection with International Application No. PCT/EP2018/052145, dated Nov. 5, 2018, 6 pages.
United Kingdom Intellectual Property Office, "Examination Report under Section 18(3)", dated Mar. 1, 2021, in connection with United Kingdom Patent Application No. GB1902814.1, 4 pages.

* cited by examiner

THROW LOCK ASSEMBLIES, THROW BOLT ASSEMBLIES, AND METHODS FOR ASSEMBLING AND USING SAME

CROSS-REFERENCE TO RELATED APPLICATIONS

This application is a 371 National Stage of International Application No. PCT/EP2018/052145, filed Jan. 29, 2018, which claims priority to United Kingdom Patent Application No. GB 1701547.0, filed Jan. 31, 2017, the disclosures of which are herein incorporated by reference in their entirety.

BACKGROUND

This disclosure relates generally to lock assemblies for locking door or gates, to bolts and bolt assemblies, to methods of assembling and using the lock assemblies; particularly but not exclusively to long-throw bolt locks.

Doors or gate mechanisms may be classified according to the degree to which they will resist attempted break-in by means of certain attack tools. For example, some door- and gateways may be designed to resist break-in attacks by means of screwdrivers, pliers and rubber hammers; some may be designed to resist break-in attacks by means of a hacksaw or crowbar; and some may be designed to resist break-in attacks by means of chisels, or heavy-duty saws and power drills. Some door- and gateways may be designed to resist a casual attack using simple tools, where the intruder is expected to be concerned with the noise and time required for breaking in; some may be designed to resist well-prepared forced entry by experienced intruders, who may be less concerned with the noise and time required. For example, some lock systems may comprise bolts provided with hardened pins.

There are various standards for classifying the break-in protection provided by various kinds of lock systems. For example, the American National Standards Institute (ANSI) and the Builders Hardware Manufacturers Association (BHMA) have set standards for lock-and-handle sets, and for lock bolts (the standard A156.5). Sold Secure™ provide standards for locks, which may be classified as Gold, Silver or Bronze, depending on factors such as the time, tools and expertise required for a break-in attack on the lock system.

SUMMARY

There is a need for lock systems for doors and gates, which can resist or retard break-in attacks, particularly but not exclusively attacks by means of steel tools, such as steel-blade hacksaws. It may be desirable for the cost of the lock systems to be as low as possible, for an installer to have a relatively high degree of flexibility in selecting the materials and/or arranging the parts, and for the working life of the lock system to be as long as possible, including when used outdoors and exposed to rain, for example; it may desirable in some circumstances for at least the visible parts of the throw lock to be substantially the same as those used on known throw locks.

According to a first aspect, there is provided a throw lock assembly for locking a gateway, comprising a throw bolt, a bolt holder and a bolt keeper, and the throw bolt comprising a cutting barrier and a bolt casing for housing the cutting barrier, the cutting barrier being harder than the bolt casing, and the bolt casing being more corrosion-resistant than the cutting barrier; configured such that when arranged as in use, the throw bolt will be moveably coupled to the bolt holder, and can be moved between a locking position and a non-locking position, in which in the locking position, a throw portion of the throw bolt will project from the bolt holder and extend into the bolt keeper, and in the non-locking position, the throw bolt will be retracted from the bolt keeper; and in which the throw portion of the throw bolt will include at least a portion of the cutting barrier, and the entire portion of the cutting barrier in the throw portion will be shielded (for example, from the environment external to the throw bolt). The abrasion resistance of the cutting barrier may be higher than that of the bolt casing.

According to a second aspect, there is provided a throw bolt assembly for a throw lock assembly as claimed in any of the preceding claims, comprising a cutting barrier and a bolt casing for housing the cutting barrier, the cutting barrier being harder than the bolt casing, and the bolt casing being more corrosion-resistant than the cutting barrier; the throw portion of the throw bolt including at least a portion of the cutting barrier, and at least the entire portion of the cutting barrier in the throw portion will be shielded (for example, from the environment external to the throw bolt). In some example arrangements, the throw bolt assembly may comprise a spacer member that can be housed within the bolt casing, arranged between the cutting barrier and a side wall of the bolt casing; in which the space member comprises material having lower hardness than the cutting barrier. The abrasion resistance of the cutting barrier may be higher than that of the bolt casing.

According to a third aspect, a method of assembling an example lock assembly is provided, in which the throw bolt comprises a spacer member, the method including assembling the throw bolt, and using a tool to remove material from the side wall of the bolt casing and from the spacer member adjacent the side wall, to form at least one recess into the spacer member, the recess not passing through the spacer member, the recess configured and arranged to accommodate an engagement member of a drive mechanism of the throw lock assembly, for engaging and moving the throw bolt in use between the non-locking and locking positions. In some examples, the method may include boring a plurality of blind holes into the throw bolt, arranged in a row.

A method of using a lock assembly can be provided, the method including attaching the lock assembly (in assembled form) to a door- or gateway (for example, attaching a part of the lock assembly to a door leaf or panel, or a gate, and a part to a doorway casing or frame, or to a wall, or to a gate post), such that the lock will be exposed to outdoor environment in use, including for example to rain and wind.

Various arrangements of throw lock assemblies and throw bolt assemblies are envisaged by this disclosure, certain non-limiting and non-exhaustive examples of which are described in the paragraphs that follow.

The bolt holder and the bolt keeper may be attached to respective members of a gateway; one of the gateway members may be a moveable barrier, such as a door panel or gate, and the other gateway member may be a corresponding fixed barrier of the gateway, such as a door frame, or a gate and gateway; or both gateway members may be moveable barriers, such as double doors or gates. When assembled, the throw bolt may be held by the bolt holder such that the throw bolt can be moved within, relative to or through the bolt holder.

The throw bolt is configured such that substantially no part or surface area of the cutting barrier in the throw portion will be substantially exposed to the external environment outside the throw bolt (in other words, the cutting barrier will not be visible in the throw portion when the throw bolt is assembled as in use); at least the portion of the cutting barrier within the throw portion will be shielded by the bolt casing or another component of the throw bolt, such as a spacer member located between the cutting barrier and the bolt casing; the portion of the cutting barrier in the throw portion will be substantially entirely enclosed within the throw bolt. In some example arrangements, the whole cutting barrier may be enclosed within the throw portion of the throw bolt; in other example arrangements, the cutting barrier may extend substantially the entire length of the throw bolt, between end caps or plates joined to opposite ends of the throw bolt, when assembled; and in some example arrangements, the spacer member may extend substantially the entire length of the throw bolt, between end caps or plates joined to opposite ends of the throw bolt, when assembled.

As used herein, the throw portion of the throw bolt will be the volume of the throw bolt that will project from the bolt holder when the throw bolt and bolt holder are assembled as in use; and as used herein, the throw distance is the distance of travel of the throw bolt (for example, of an end of the throw bolt) when the throw bolt moves as from the non-locking to the locking positions. In some example arrangements, the throw bolt and bolt holder may be configured such that when assembled as in use, the throw bolt will travel a throw distance of at least about 2.0 cm, at least about 3.0 cm, at least about 5.0 cm, or at least about 7.0 cm, and/or at most about 10 cm, when it is moved from a non-locking position. In a particular example, the throw of the throw bolt may be about 80 mm.

In some example arrangements, at least one of the ends of the throw portion may be non-planar, or an end may not be perpendicular to the longitudinal axis of the throw bolt; this may arise, for example, because of a non-planar and/or non-perpendicular shape of the fore end of the bolt holder, from which the throw bolt will project as when in the locking position (the longitudinal axis of the throw bolt being along the direction of travel of the throw bolt relative to the bolt holder, when the throw bolt moves relative to the bolt holder as between the non-locking and locking positions). In general, as used herein, the length of the throw portion will be the longest distance between its ends, measured parallel to the longitudinal axis; the length of the throw portion may not be equal to the throw distance, and the length of the throw portion may be greater than the throw distance, since a tip of the throw portion may project from the bolt holder when the throw bolt is in the non-locking position.

In some example arrangements, the length of the cutting barrier may be at least equal to the throw distance. In some example arrangements, the throw bolt may extend longitudinally between proximal and distal ends, which may be defined by the external surfaces of respective end plates or caps; and the cutting barrier may extend longitudinally between the end plates or caps. In some example arrangements, the cutting barrier may project into the throw portion through an internal boundary of the throw portion; and the cutting barrier may extend up to the distal end plate or end cap, when assembled. In some examples, the cutting barrier may extend from the proximal end to the distal end of the throw bolt, when assembled.

In some example arrangements, the throw lock assembly may be configured such that when assembled as in use, and the throw bolt is in the locking position, the cutting barrier will extend into the throw portion at least to the nearest end of the bolt keeper. In other words, the volume of the throw portion extending from the bolt holder to the nearest end of the bolt keeper (when in the locking position) can be referred to as an intermediate portion, and the cutting barrier may extend at least the entire length of the intermediate portion; in some examples, the cutting barrier may extend a length greater than the intermediate length; when the throw bolt is in the locking position, the cutting barrier may extend (encased within the throw bolt) into the throw portion and into or through a volume of the throw portion that will be contained within the bolt keeper.

In some examples, the bolt casing may define an external surface of the throw bolt and be compliant with the EN 1670 European standard for corrosion resistance of building hardware; the bolt casing may have a salt-spray (NSS) corrosion resistance of at least 1,000 hours, or at least 2,000 hours, according to the EN 1670 standard and/or neutral salt spray test in accordance with the ISO 9227 standard for neutral salt spray testing. In various examples, the bolt casing may exhibit corrosion resistance of grade 2, grade 3 or grade 4 according to the EN 1670 European standard. This may be advantageous if an example throw lock system were exposed to the outdoor environment in use (for example, exposed to rain, or to water containing salt).

In some example arrangements, the bolt casing may comprise or consist of stainless steel, for example 304 or 316 stainless steel; or the bolt casing may comprise or consist of polymer, such as nylon. The bolt casing may comprise or consist of material having Rockwell C hardness of about 40 HRc; and/or material having a hardness of at least about 35 HRc; and/or material having a hardness of at most about 50 HRc, or at most about 45 HRc.

In some example arrangements, the cutting barrier may comprise or consist of material having Rockwell C hardness of at least about 55 HRc, or at least about 60 HRc, or at least about 65 HRc, or at least about 75 HRc. For example, the cutting barrier may comprise or consist of technical ceramic material (for example aluminium oxide, tungsten carbide), cemented carbide material, cast iron, polymer material, high-carbon steel, hardened steel, or nickel alloy material. The cutting barrier may be configured such that it can resist attack by means of a tool, in which the blade, point, edge or bit of the tool may comprise or consist of steel, or other material having hardness of at least about 55 HRc, or at least about 60HRc; and/or at most about 65 HRc, or at most about 80 HRc. For example, the tool may comprise a saw blade, drill bit, or a chisel edge. In some examples, the cutting barrier may resist being broken, cut, sawn or drilled within 5, 10 or 15 minutes of continuous attack by a tool, for example a steel hacksaw blade.

In some example arrangements, the bolt casing may comprise or consist of a plurality of cooperatively configured casing members; and in some example arrangements, the bolt casing may comprise a tube, sleeve, or jacket configured for accommodating at least the cutting barrier; or the bolt casing may comprise a casing body and a cover plate; configured such that the casing body defines a cavity for accommodating the cutting barrier, and the cover plate can be joined to the casing body to enclose the cutting barrier within the cavity. For example, one or two cover plates may be welded to the casing body, or attached by bolt or screws fastenings, or mechanical interlocking (for example, the cover plate may clip onto the casing body, or it may slide onto the casing body by means of a tongue and groove mechanism).

In some example arrangements, the bolt casing may comprise or consist of a layer disposed on the surface of the cutting barrier, for example by means of a coating, cladding or thermal spray process.

In some example arrangements, the bolt casing may comprise a tubular body, configured for containing the cutting barrier within a cavity extending between opposite ends of the tubular body, or from one end of the cavity to an opposite end; or the bolt casing may comprise a bar or rod provided with a recess in a side thereof, configured for accommodating the cutting barrier, in which the recess may extend at least about one third or at least about two thirds of the length of the bar or rod. For example, the bolt casing may comprise an elongate tube having a transverse cross-section that is generally square, rectangular, other polygonal, circular, or oval, or a shape including polygonal and arcurate portions. In some examples, the bolt casing may be in the general form of a tube including a cavity extending between opposite ends of the tube, one or both of which may be open or closed, at least when not fully assembled. The interior surface of the cavity may be conformal and/or concentric with the external surface of the casing body. In some examples, the bolt casing may be in the general form of a bar or rod, having a recess or groove formed into a side thereof, for accommodating the cutting barrier.

In various example arrangements, the bolt casing may comprise a tube having a length of at least about of at least about 20 mm, or at least about 30 mm, or at least about 50 mm; and/or the spacer member may have a length of at most about 200 mm, or at most about 190 mm, or at most about 180 mm, or at most about 168 mm. In some examples, the bolt casing may comprise a tube having a length of about 168 mm. In some example arrangements, the external shape of the tube may be a square or rectangular prism, having width and/or breadth of at least about 10 mm, or at least about 15 mm; and/or at most about 25 mm, or at most about 20 mm. In some examples, the tube may have a square (transverse) cross-section, the side breadth of which may be about 18 mm. The tube may comprise side walls, for example four side walls, having thickness of at least about 0.5 mm, or at least 1 mm; and/or at most about 2 mm, or at most about 1.5 mm. In some examples, the tube may have a substantially uniform wall thickness of about 1 mm. The bolt casing may comprise a pair of end plates joined or capable of being joined to opposed open ends of the tube, to enclose the cutting barrier within the bolt casing. In examples, each end plate may have a thickness of at least about 1 mm, and/or a thickness of at most about 3 mm.

In some example arrangements, the cutting barrier may comprise or consist of a rod or bar; in some examples, the cutting barrier may comprise or consist of a plurality of barrier members; for example, two or three barrier members, each of which may be in the form of a bar or rod. In some example arrangements, the cutting barrier may be in the form of a rod, which may substantially have the shape of a square or rectangular prism. In some example arrangements, the cutting barrier rod may have a length of at least about 20 mm, or at least about 30 mm, or at least about 50 mm; and/or the cutting barrier rod may have a length of at most about 200 mm, or at most about 190 mm, or at most about 180 mm. In some examples, the cutting barrier rod may have a length of about 168 mm. In some example arrangements, the cutting barrier rod may have a breadth of at least about 2 mm, or at least about 5 mm; and/or the cutting barrier rod may have a breadth of at most about 20 mm, or at most about 15 mm, or at most about 10 mm. In some examples, the cutting barrier rod may have a breadth of about 8 mm. In some example arrangements, the cutting barrier rod may have a width of at least about 10, or at least about 15 mm; and/or the cutting barrier rod may have a width of at most about 20 mm. In some examples, the cutting barrier rod may have a width of about have a width and/or a breadth of substantially the same width and/or breadth, respectively, as the cavity of the bolt casing.

In some example arrangements, the spacer member may have a width of at least about 5 mm, or at least about 7 mm; and/or the spacer member may have a width of at most about 20 mm, or at most about 15 mm, or at most about 10 mm, or at most 8 mm.

In some example arrangements, the throw bolt may comprise a spacer member, the cutting barrier being harder than the spacer member; configured such that when assembled as in use, the spacer member will be enclosed within the bolt casing, and disposed between the cutting barrier and a side wall of the bolt casing, spacing the cutting barrier apart from the side wall. For example, the spacer member may have Rockwell C hardness of at most about 62 HRc, and/or at least 50 HRc. In some examples, the spacer member may comprise or consist of stainless steel, for example grade 201 stainless steel, aluminium, or zinc alloy material.

In some example arrangements, the spacer member may comprise or consist of material having higher strength, hardness and/or abrasion resistance than the bolt casing; and in some examples, the spacer member may comprise or consist of material having lower strength, hardness and/or abrasion resistance than the bolt casing. For example, the spacer member may comprise stainless steel, or zinc alloy material.

In some example arrangements, the spacer member can be accommodated adjacent at least a portion of the bolt casing. For example, the spacer member may be elongate, and the casing member of the bolt casings, and spacer member may be configured such that when assembled, the spacer member will lie along at least a part of the length of the bolt casing, adjacent or abutting an internal side of the cavity of the bolt casing. In such examples, a recess or blind hole suitable for accommodating a tooth of a drive mechanism can be formed into the spacer member (through the sheath), without material being removed from the cutting barrier.

In some example arrangements, the bolt casing may define an elongate cavity, and the cutting barrier and spacer member may comprise or consist of respective elongate bodies; configured such that the bolt casing and the cutting barrier can be disposed within the cavity, extending between opposite ends of the cavity, opposite side boundaries of the spacer member being adjacent respectively the cutting barrier and an internal surface of the bolt casing.

In some example arrangements, the spacer member may have sufficient thickness between the side wall of the bolt cavity and cutting barrier, when assembled, and sufficient width that at least one blind hole can be formed through the bolt casing and to a depth into the spacer member, the blind holes having dimensions sufficient for a tooth of a drive mechanism to gain sufficient purchase on the throw bolt to drive it between the non-locking and the locking positions in use. In various example arrangements, the spacer member may comprise a bar or rod having a thickness of at least about 5 mm, or at least about 6 mm; and/or the spacer member may have a thickness of at most about 14 mm, or at most about 10 mm.

In some example arrangements, the spacer member may have a width of at least about 5 mm, or at least about 7 mm; and/or the spacer member may have a width of at most about 20 mm, or at most about 15 mm, or at most about 10 mm, or at most 8 mm. In some example arrangements, the spacer member may have a length of at least about 20 mm, or at least about 30 mm, or at least about 50 mm; and/or the spacer member may have a length of at most about 200 mm, or at most about 190 mm, or at most about 180 mm, or at most about 168 mm.

The throw bolt assembly may be provided assembled or unassembled; and the throw bolt assembly may be provided without blind holes for driver members to engage the throw bolt (for example, without holes for accommodating teeth or finger members of a driver mechanism. These holes may be formed by an installer, after the throw bolt has been assembled, and during the process of installing the throw lock assembly onto a gateway).

In some example arrangements, the throw bolt may be provided with an array or a row of recesses or blind holes, formed into a side of the bolt, through the bolt casing. In some examples, the hole or holes may be formed into the cutting barrier, and/or into the spacer member. The recesses or holes may be configured and arranged to accommodate members of a locking/unlocking mechanism (for example a key mechanism) for engaging and moving the bolt. For example, the recesses or holes may be configured and arranged for engagement by teeth of a key mechanism. The recesses or holes may be formed to a high dimensional accuracy, to achieve a smooth locking and unlocking action.

In some example arrangements, the spacer member may comprise or consist of a bar having with a recess configured to accommodate the cutting barrier.

In some example arrangements, the bolt casing may define an elongate cavity, and the cutting barrier and spacer member may comprise respective elongate bodies; configured such that the bolt casing and the cutting barrier can be disposed within the cavity, extending between opposite ends of the cavity.

In some example arrangements, the cutting barrier and/or the spacer member may be the form of respective square or rectangular prisms, one or both of which may be configured to extend substantially the entire length of the cavity defined by the bolt casing; or substantially the entire length of the bolt casing, apart from end caps if these are present; in other words, the barrier member and/or the spacer member may connect opposite (proximal and distal) ends of the bolt casing.

In some example arrangements, the throw bolt assembly may comprise the bolt holder, which can moveably accommodate the throw bolt and comprises a channel extending between proximal and distal ends (of the bolt holder and the channel), the channel configured such that the throw bolt can slide coaxially within the channel, between a retracted position and a projecting position, in which when the throw bolt is in the projecting position, a throw portion of the throw bolt including a distal end of the throw bolt projects from the distal end of the channel; and when the throw bolt is in the retracted position, its distal end will be relatively more proximate to the distal end of the channel than when it is in the projecting position; in which the bolt holder and the throw bolt are configured such that the throw portion of the throw bolt includes at least a portion of the cutting barrier, and the entire portion of the cutting barrier in at least the throw portion is shielded.

In some examples, the bolt holder may comprise a bracket that can be attached to a gateway (for example, to a door leaf, a door frame, a gate, or a gate post); when the bolt holder bracket is attached to the gateway as in use, the channel may be closed on one side by a surface of the gateway, providing a generally tubular channel having open proximal and distal ends. When arranged as for use, the distal end of the channel, and of the throw bolt, will face towards the bolt keeper, so that when the throw bolt is moved to the projecting position, a part of it will be inserted into (or through) the bolt keeper. This will correspond to the locking position, and the entire volume of the throw bolt that projects from the distal mouth of the channel will form the throw portion, as used herein. Within the throw bolt, at least a portion of the cutting barrier will extend into the throw portion (or the entire cutting barrier may be included within the throw portion).

The volume of the throw portion that extends from the distal mouth of the channel (the fore end of the bolt holder) to the nearest end of the bolt keeper will form an intermediate portion of the throw bolt. In some example arrangements, the cutting barrier within the throw bolt may extend from a proximal end of the throw portion, to at least the distal end of the intermediate portion (in this example arrangement, the proximal end of the throw portion will be coterminous with the proximal end of the intermediate portion, and correspond to the mouth of the bolt holder when in the projecting, or locking, position; and the distal end of the intermediate portion will correspond to the end of the bolt keeper that faces the bolt holder). In example arrangements where the cutting barrier extends over at least the intermediate portion of the throw portion, the cutting barrier will be encountered when there is an attempt to cut through the throw bolt between the bolt holder and the bolt keeper. In some example arrangements, the cutting barrier may extend from the proximal end of the throw portion substantially to the distal end of the throw bolt (up to a distal end plate or end cap of the throw bolt). In some example arrangements, the cutting barrier may extend from substantially the proximal end of the throw bolt (form a proximal end plate or end cap) to the distal end of the throw bolt (to a distal end plate or end cap). No part of the cutting barrier will be exposed in the throw portion, and the entire portion of the cutting barrier within the throw portion will be shielded, for example by the bolt casing and/or by a spacer member. In other words, the portion of the cutting barrier that extends in the throw portion will be enclosed within the throw bolt, to protect the cutting barrier from exposure to the external environment, such as rain or other sources of water, particularly when the throw bolt is in the projecting, or locking position.

Disclosed example lock assemblies and bolt assemblies may have the aspect of exhibiting high resistance to chemical wear (particularly corrosion), particularly but not exclusively when the throw lock or throw bolt are used in an outdoor environment, or generally in an environment in which the throw lock and throw bolt may be exposed to corrosive or other chemical agents that may degrade the throw bolt.

Disclosed example throw lock assemblies and throw bolt assemblies may have the aspect of resisting break-in attacks, at least by means of a saw tool, such as steel blade hacksaw. In particular, the cutting barrier may be substantially more challenging than the lock casing to attack by abrasive means such as a steel-bladed saw, owing to the higher abrasion resistance and/or hardness of the former compared to the latter. Since the cutting barrier will extend within the lock casing across the entire gap from at least the bolt holder to or into the bolt keeper, when the throw bolt is in the locking position, the cutting barrier will resist cutting through the throw bolt at any position along the bolt within the gap. In other words, a break-in attacker would require substantially more time to cut through an example disclosed throw bolt comprising a cutting barrier, than would be required if the cutting barrier were not present. In some example arrangements, the presence of the cutting barrier may result in an attacker requiring at least about 5 minutes, at least about 10 minutes, or at least about 15 minutes of continuous sawing using a steel blade hacksaw to cut through an example disclosed throw bolt.

Disclosed example throw lock assemblies and throw bolt assemblies may have the aspect of both good corrosion resistance (and/or resistance to other chemical wear) and good resistance to break-in attach, at least by means of certain steel tools. Enclosing substantially the whole cutting barrier within the lock casing, such that substantially no surface area of the cutting barrier will be directly exposed to the environment, may allow relatively hard and abrasion resistant materials, such as hardened steel grades, to be used in throw bolts that may be installed outdoors, or in other potentially corrosive environments.

In disclosed examples of lock assemblies comprising spacer members, recesses or holes may be formed into the spacer member for allowing allow teeth or finger members of a driver mechanism (for example, teeth of a gear mechanism coupled to a key mechanism) to engage the throw bolt and drive it to move between a locking and non-locking position. Where the material of the spacer member is harder or more abrasion resistant than that of the bolt casing, the shape and dimensional tolerances of the recesses or holes may be preserved for a substantially longer period of use. This may occur owing to the reduced rate of mechanical wear of the material of the spacer member than that of the bolt casing, resulting in an extended period of smooth, reliable operation. Since the material of the spacer member is less hard than that of the cutting barrier, it will be easier to form the holes into the spacer member than into the cutting barrier, and the presence of a spacer member may avoid the need to use specialist tools, more powerful or expensive tools to form the holes. Consequently, the holes may be formed in the throw bolt after it has been assembled, and by means of a hand-held tool equipped with a steel blade, bit or bit (rather than a cemented carbide bit, for example). In some circumstances, it may be desirable to form the recesses or holes into the bolt when the lock assembly is being installed on a gate- or doorway (in situ, in other words), using a hand-held power tool.

Certain disclosed example lock and bolt assemblies may have the aspect of enabling relatively rapid, efficient and simple assembly, including when the lock assembly is being installed on a gate- or doorway. For example, the cutting barrier and the spacer member can be inserted into a cavity formed by the bolt casing, and the cavity may then be closed by one or more end plates, or a side plate.

BRIEF DESCRIPTION OF THE DRAWINGS

Non-limiting example arrangements of throw lock and throw bolt assemblies will be described in more detail with reference to the accompanying drawings, of which:

FIG. 10A shows a front view of the locking assembly, arranged as installed on a gateway and in the locking position; FIG. 10B shows a longitudinal cross-section view (upper) and a bottom view of an example throw bolt; FIG. 10C shows transverse (left) and longitudinal (right) cross-section views through an example bolt casing tube; FIG. 10D shows transverse (left) and longitudinal (right) cross-section views through an example cutting barrier rod; FIG. 10E shows transverse (left) and longitudinal (right) cross-section views through an example spacer rod; and FIG. 10F shows a longitudinal (upper) and top view (lower) of an example sheath for a bolt keeper.

DETAILED DESCRIPTION

Figure 1A:
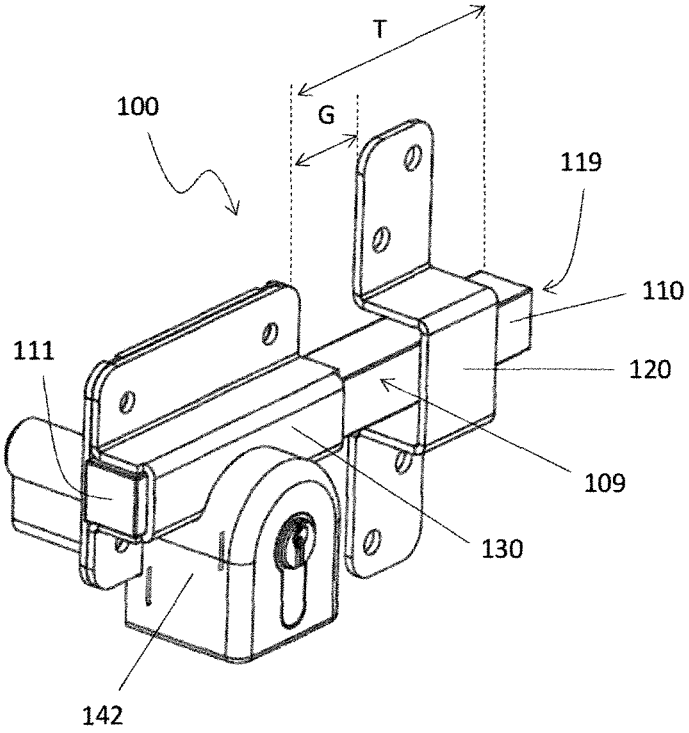
FIG. 1A shows a schematic perspective view of an example lock assembly.

With reference to FIG. 1A to FIG. 10F, example throw lock assemblies 100 for locking a gateway 200, 200A, 200B may comprise a throw bolt 110, a bolt holder 130 and a bolt keeper 120. The bolt keeper 120 may comprise a metal bracket 122 for receiving an end portion of the throw bolt 110. The bolt holder 130 houses the throw bolt 110, such that the throw bolt 110 can slide within the bolt holder 130 between non-locking and locking positions. The bolt housing 130 and bracket 120, 122 may comprise plates provided with screw-holes 152 (FIG. 2A), through which screws 150 (FIG. 3A) can be driven to attach the bolt housing 130 and bracket 120, 122 to respective gateway members 200A, 200B (shown in FIG. 2A). For example, the bolt holder 130 may be attached to a door panel or a gate, and the bolt keeper 120 may be attached to a corresponding door frame, gate post or wall; or the bolt keeper 120 may be attached to a door panel or a gate, and the bolt holder 130 may be attached to a corresponding door frame, gate post or wall. FIG. 2B shows a transverse cross-section view of the example throw lock assembly 100 mounted onto the gateway member 200A, the view being from the proximal end 111. The throw lock assembly may have a long throw, in which the throw bolt may travel a throw distance of about 80 mm between the non-locking position and locking positions.

Figure 2A:
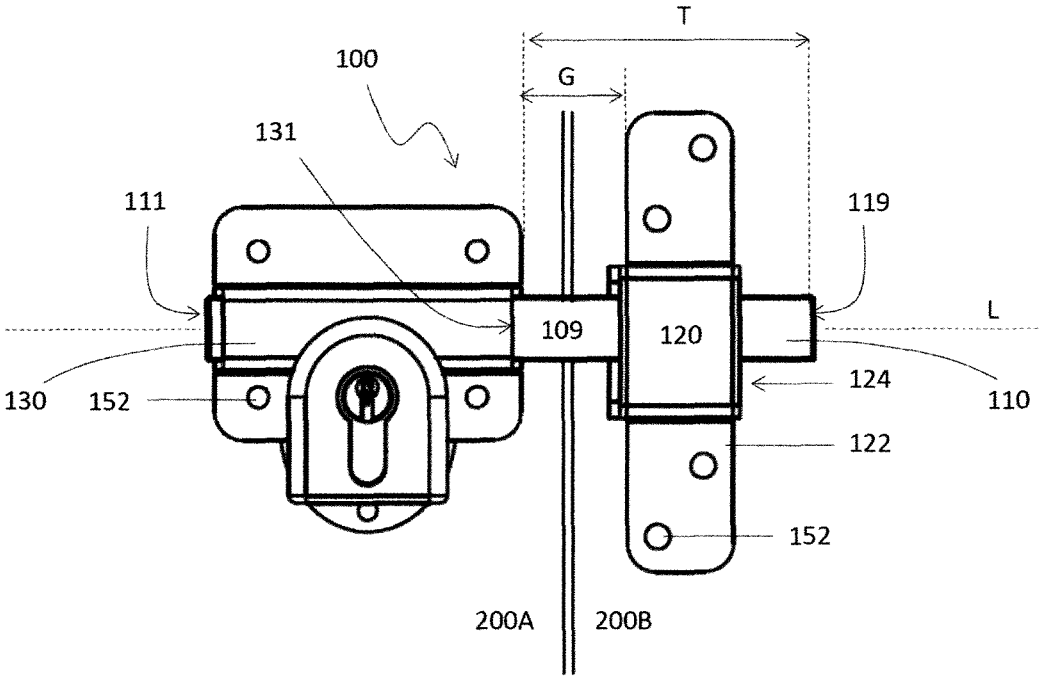
FIG. 2A shows a schematic front view of an example lock assembly attached to a schematic gateway.

When the throw bolt 110 is coupled to the bolt holder 130 as in use, a throw portion T of the throw bolt 110 will project from a fore end 131 of the bolt holder 130 when the throw bolt 110 is positioned relative to the bolt holder 130 as in the locking position, as illustrated in at least FIG. 2A. When the throw lock 100 is arranged as in use, an intermediate portion 109 of the throw portion T will extend from the fore end 131 of the bolt holder 130 to the nearest end of the bolt keeper 120, the intermediate portion 109 having a length G. In the example illustrated, the fore end 131 of the bolt holder 130 and the nearest end of the bolt keeper 120 lie on respective planes, each perpendicular to the longitudinal axis L of the throw bolt (shown in FIG. 2A). In the illustrated example, the throw bolt 110 has substantially the shape of a square rectangular prism extending from a proximal end 111 to a distal end, and the throw portion T also substantially has the shape of a square rectangular prism, extending from the fore end 131 of the bolt holder 130 to the distal end 119.

The throw bolt 110 may have the external form of an elongate square rectangular bar having proximal and distal ends 110A, 110B, the end portion of the throw bolt 110 being adjacent the distal end 119. Substantially the whole (external) surface of the throw bolt 110 may comprise stainless steel for good corrosion resistance, which may be particularly—but not exclusively—relevant where a throw lock assembly 100 is used on an outdoor gateway. The throw lock assembly 100 may also comprise a single or double locking cylinder 140 and cylinder cover 142 for a key mechanism to move the throw bolt 110 in use, between the non-locking and locking positions. The throw lock assembly may comprise other components, such as an escutcheon and lock base.

When the throw bolt assembly 100 is installed on a gateway 200A, 200B, the throw bolt 110 can slide within the bolt holder 130, in response to rotation of a gear wheel 144 (shown in FIG. 5) mounted in the locking cylinder 140 and driven by the action a key mechanism. The gear wheel 144 may have a plurality of teeth 146 arranged radially around its circumference, and the throw bolt 110 may have corresponding recesses 115 (shown in FIG. 4B) provided in an under-side of the throw bolt 110, arranged in a row and shaped to receive the teeth 146 with sufficient purchase for the teeth 146 to engage and drive the throw bolt 110 between the non-locking and locking positions in use. When the throw bolt 110 is in the non-locking position, it will be maximally retracted from the bolt keeper 120 to allow the gateway to open, and when it is in the locking position (as shown in FIGS. 1A, 1B and 2A), the throw bolt 110 will maximally project from the bolt holder 130, its end portion being inserted into the bolt keeper 120.

When the throw lock assembly 100 is installed on a gateway for use, and throw bolt 110 is in the locking position, an intermediate length 109 of the throw bolt 110 will extend over a gap length G from an end (fore-end) of the bolt holder 130 to the nearest end of bolt keeper 120, across a spacing between the respective gateway members 200A, 200B. In this position, the throw bolt 110 will interlock the bolt holder 130 and the bolt keeper 120, thus locking the gateway. The intermediate length 109 will be a portion of the throw bolt 110 that may be accessible to an intruder attempting to break in through the gateway, and may be a target for a break in attack. For example, an intruder may attempt to break in by sawing (or cutting or boring) through the intermediate portion 109 of the throw bolt 110, by means of a tool having a steel blade, tip or bit, which may operate by causing abrasive wear of the throw bolt 110.

Figure 1B:
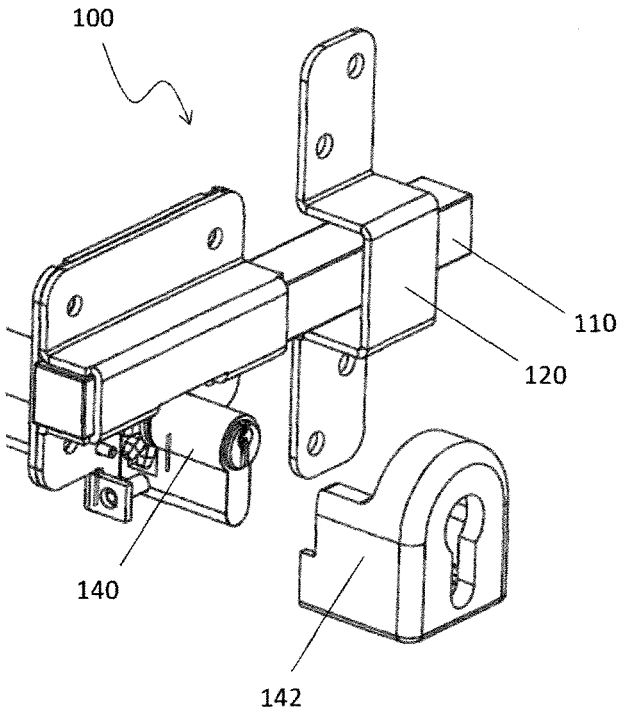
FIG. 1B shows a partially exploded perspective view of the example lock assembly.
Figure 2B:
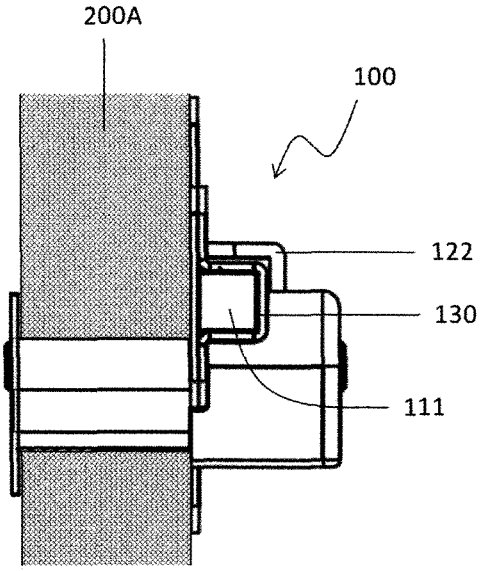
FIG. 2B shows a transverse cross-section through a part of the example lock assembly and a part of the gateway.
Figure 3A:
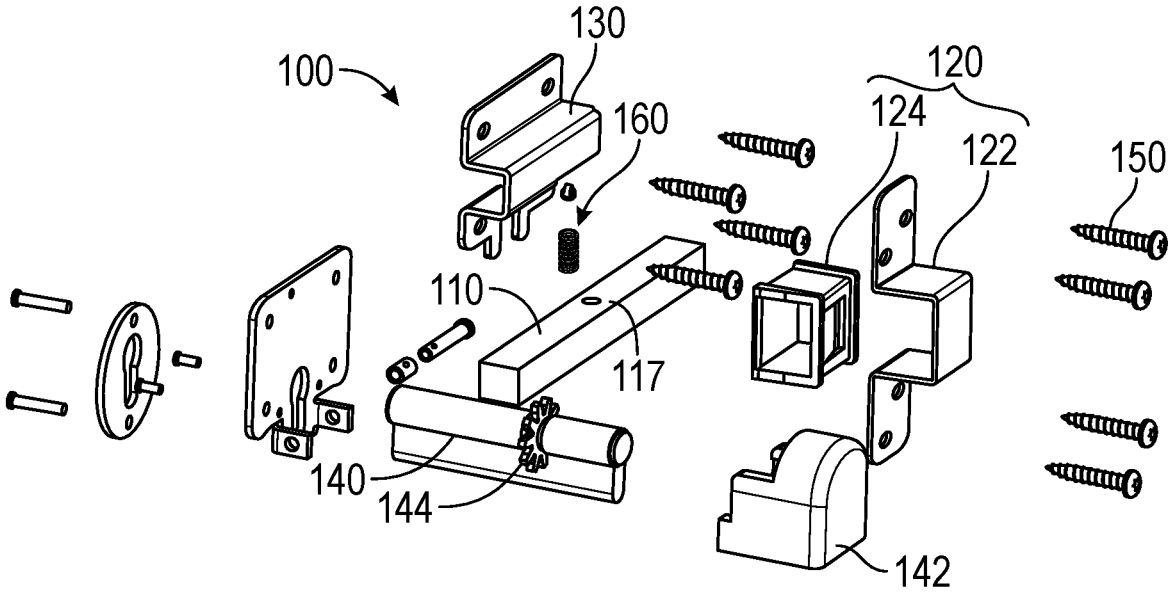
FIG. 3A shows an exploded view of an example lock assembly.
Figure 3B:
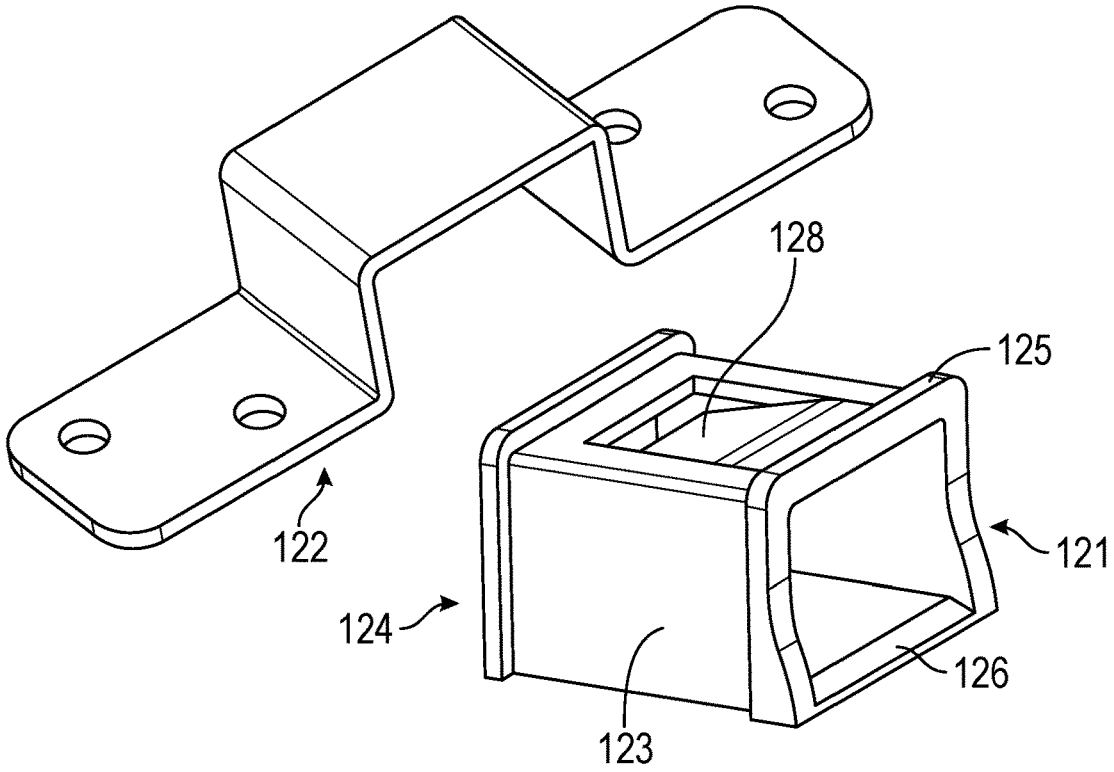
FIG. 3B shows a bracket and an example sheath of an example bolt keeper.
Figure 3C:
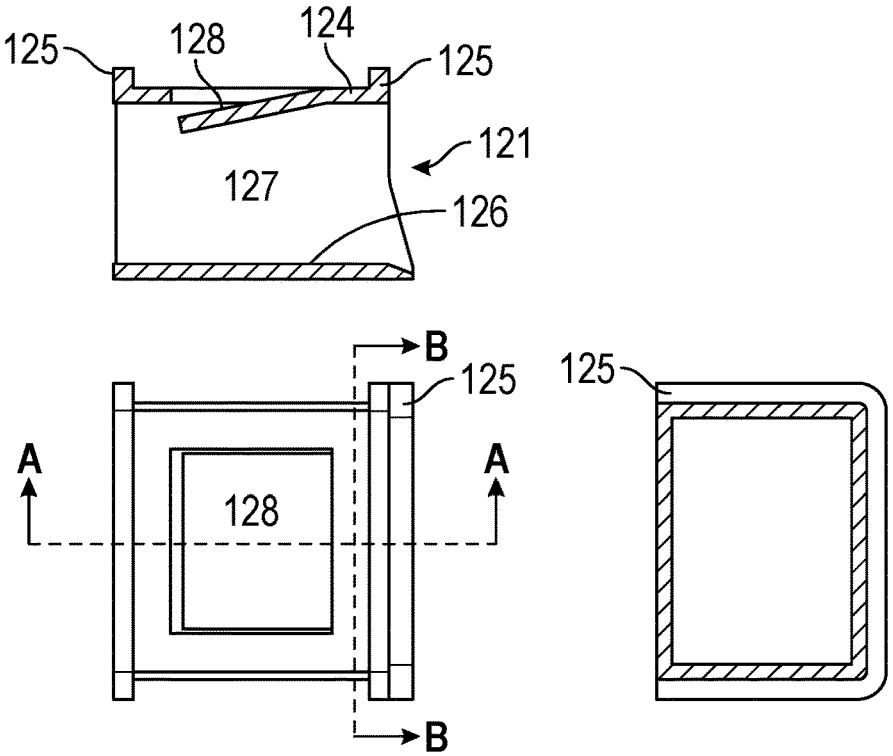
FIG. 3C shows a top view of the example sheath, as well as cross-section views of the sheath on the planes A-A and B-B.

In the particular example shown in FIGS. 1A and 1B, the bolt keeper 120 comprises just the metal bracket configured for receiving an end portion of the throw bolt 110, and in the example shown in FIGS. 2A and 2B, the bolt keeper 120 may comprise a metal bracket 122 and a plastic sheath 124, in which the sheath 124 is fitted within the bracket 122 and is configured for receiving the end portion of the throw bolt 110. With reference to FIG. 3B, an example sheath 124 may be provided as a separate member, which can be inserted into the bracket 122 and mounted against a gateway member by means of the bracket 122. In the example shown, the sheath 124 may comprise a tubular body 123 having a cavity extending between proximal and distal ends, the proximal end 121 being configured for receiving the end portion of the throw bolt 110 in use. The example sheath may comprise respective flanges 125 provided at each open end, configured such that the bracket 122 will fit between the flanges 125 and the flanges will resist or prevent the sheath 124 from being extracted from the bracket 122.

In the particular example shown, the tubular body 123 of the sheath 124 comprises four side walls, arranged to define a substantially square rectangular cavity 127 corresponding to the shape and dimensions of the throw bolt 110. In some examples, the sheath 124 may be formed by a method including extrusion and/or moulding of plastic material. One of the side walls 126 will be positioned against the gateway member 200B (or 200A) when installed for use, and provide a buffer that will space the end portion of the throw bolt 110 apart from the gateway member 200B when the throw bolt is in the locking position. The tubular member 123 may comprise a tongue 128 depending from an opposite side wall at an angle of about 10 to 15 degrees. The tongue 128 extends away from the proximal end 121, such that when the throw bolt 110 is inserted into the sheath 124, it will urge the tongue 128 to deflect towards the side wall from which it depends, the tongue 128 providing some resistance to the insertion of the throw bolt 110. In this example, the tongue is formed as an integral part of the tubular member 123 and consists of the same resilient plastic material, and is disposed so that it will allow the throw bolt 110 to be inserted into the cavity, and once the throw bolt 110 has been fully inserted (in the locking position) the tongue 128 will bear on the throw bolt 110 and urge it against the buffer side wall 126. The clamping force applied to the throw bolt 110 by the tongue 128 may be sufficient to resist movement of the throw bolt 110 within the bolt keeper 120, which might tend to arise from wind or other incidental forces acting on the gateway members 200A, 200B. Consequently, the bolt keeper 120 may have the aspect of reducing or substantially preventing the throw bolt 110 from rattling within it. In this example, the buffer side wall 126 of the sheath 120 is also formed as an integral part of the tubular body 123, and also consists of the same resilient plastic material as the rest of the sheath 120. It may provide the additional aspect of preventing, or at least reducing the risk of the throw bolt 110 from scratching the surface of the gateway member 200B (200A) as it is moved between the non-locking and locking positions in use. This may be especially relevant when the gateway member 200B (200A) comprises high quality, relatively costly wood or other material that is softer that stainless steel.

Figure 4A:
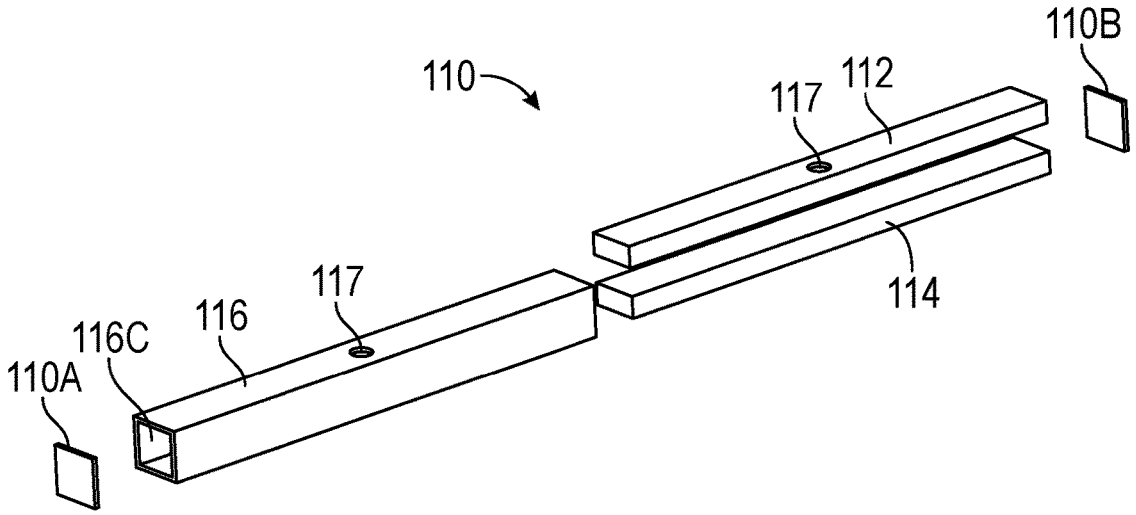
FIG. 4A shows a schematic exploded perspective view of an example throw bolt.
Figure 4B:
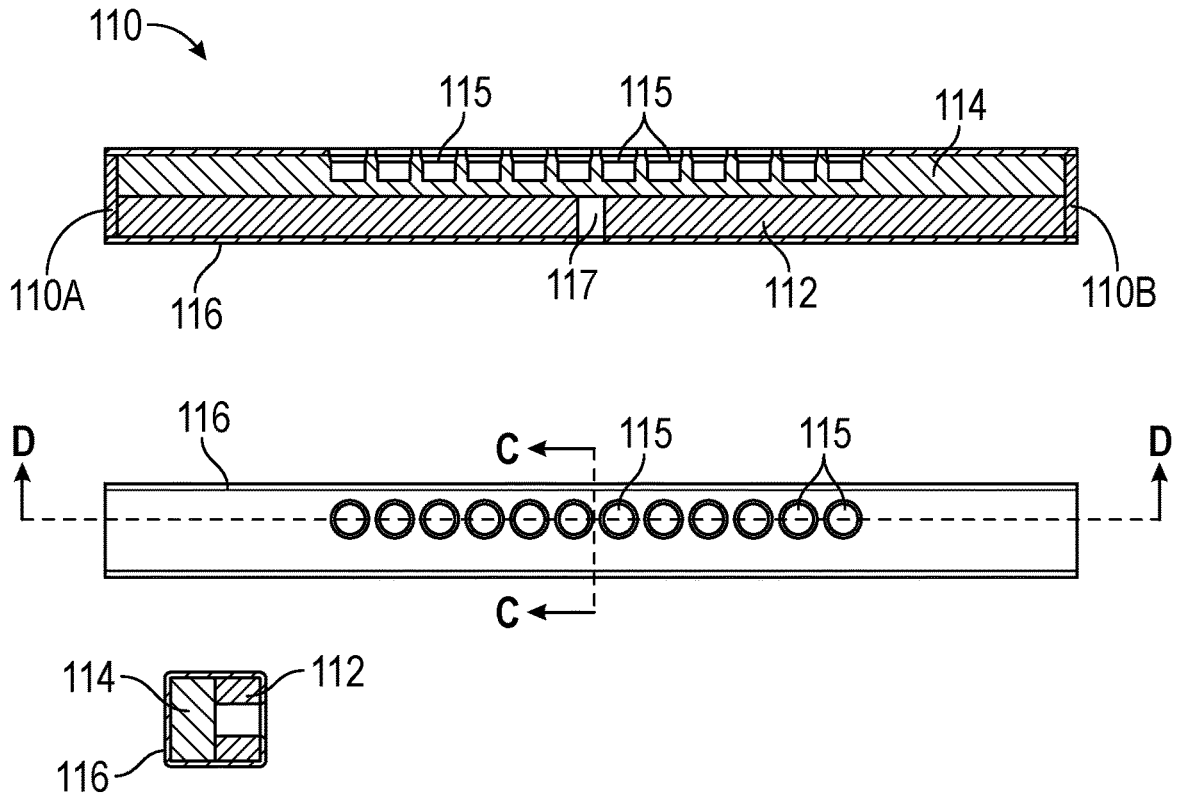
FIG. 4B shows (centre) a bottom view of an example bolt, (upper) a longitudinal cross-section view through the bolt on the plane D-D, and (bottom) a transverse cross-section view through the bolt on the plane C-C.

With reference to FIGS. 4A and 4B, example throw bolts 110 may comprise an assembly of a bolt casing 116, 110A, 110B, a cutting barrier 112 and a spacer member 114. The bolt casing comprises a casing tube 116 and a pair of end plates 110A, 110B welded to the proximal and distal ends, respectively, of the casing tube 116. The casing tube 116 and end plates 110A 110B consist of 304 stainless steel (in other examples, the stainless steel may be another grade, such as 316 stainless steel). The casing tube 116 is in the form of a right rectangular tube having a width of about 18 mm, a length of about 170 mm and side walls of having a thickness of about 1 mm. Each end plate 110A, 110B may be about 2 mm thick at their edges. The cutting barrier 112 and the spacer member 114 may consist of rods having the general shape of right rectangular prisms, each having a length of about 168 mm, and a transverse cross section height of about 8 mm and breadth 16 mm. The cutting barrier rod 112 may consist (apart from a minor amount of impurities) of hardened steel grade Q235, and may have a surface finish formed by zinc plating, and the spacer rod by consist (apart from a minor amount of impurities) of 201 stainless steel, or aluminium. When the throw bolt 110 is assembled, the cutting barrier rod 112 and spacer rod 114 will be enclosed within the casing body 110, between the end plates 110A, 110B, the spacer rod 114 and cutting barrier rod positioned against an opposite internal surfaces of respective side walls of the casing tube 116. A hole 117 may be provided through the bolt casing 116 and into, or through, the cutting barrier rod 112, for accommodating a resilient biasing means such as a spring, which may bias the throw bolt 110 against an internal side surface of the bolt housing 130 in use. A ball bearing (a ball bearing and corresponding biasing means in the form of a coiled spring are indicated as 160 in FIG. 3A) may be positioned between an end of the spring (the end that will protrude from the hole 117) and the internal surface of the bolt holder 130, such that when the throw bolt 110 is moved within the bolt holder 130 between locking and non-locking positions, the spring can urge the throw bolt 110 away from the internal surface, for example to reduce or eliminate potential rattling of the throw bolt 110 within the bolt holder in use, and the ball bearing can roll along the internal surface of the bolt holder 130 to reduce friction between the spring and the internal surface, and thus provide smooth movement of the throw bolt 110 between the locking and non-locking positions. When the throw bolt assembly 100 is assembled as in use, the hole 117 will house the biasing means and will face the internal surface of the bolt holder 130. Consequently, the hole 117 will not be in the throw portion T of the throw bolt 110, and the cutting barrier 112 will in effect be shielded from the external environment by being covered within a housing provided by the bolt holder 130 (in addition to the spring and ball bearing 160).

Figure 5:
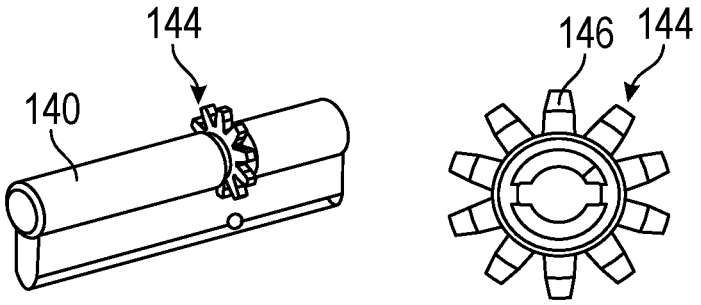
FIG. 5 shows a perspective view of an example lock cylinder, and a front view of a gear wheel mechanism for engaging the throw bolt.

In some examples, the casing tube 116, end plates 110A, 110B, cutting barrier rod 112 and spacer rod 114 may be provided unassembled, potentially in kit form, and the throw bolt may be provided by assembling these parts. In this example, a row of twelve blind holes 115 may be formed into the side of the throw bolt 110 against which the spacer rod 114 is positioned (in other example arrangements, different numbers of blind holes may be formed, depending on the throw of the lock assembly). Each of the blind holes 115 has a generally cylindrical shape and a flared mouth (the mouth formed by a conical internal surface area, having a cone angle of about 30 degrees), configured to receive the teeth 146 of the gear wheel 144 coupled to the key mechanism housed in the locking cylinder 140 (as shown in FIG. 5). Each blind hole has a depth of about 6 mm, a diameter of about 5.6 mm at the depth, and a diameter of about 7 mm at the mouth, and the central axes of successive holes may be about 8 mm apart from each other. Each hole 115 extends through a side wall of the casing tube 116 and to a depth of about 5 mm into the spacer rod 114 (in this example, the holes do not extend through the spacer rod).

In some examples, the holes 115 for the gear teeth 146 may be formed after the throw bolt 110 has been assembled. Owing to the presence and arrangement of the spacer rod 114, the holes may be bored into the throw bolt 110 by means of a hand-held tool comprising a steel blade, bit or tip, since in this example it will not be necessary to bore into the hardened steel cutting barrier rod 112. This may have the aspect of allowing the holes to be bored when the lock assembly is being installed on a gateway (in examples arrangements that do not comprise a spacer member, it may be necessary to form the holes 115 into the cutting barrier 112, which may require specialist tools having a cemented carbide blade, tip or bit, due to the high hardness of the cutting barrier).

When the lock assembly 100 is installed on a gateway 200A, 200B for use, and the throw bolt 110 is in the locking position, the intermediate length 109 extending from for fore-end of the bolt housing 130 and the nearest end of the bolt keeper 120 may be about 26 mm in the illustrated examples (in various example arrangements, and for various throw lengths, the intermediate length may be about 10 mm to 30 mm).

Figure 6:
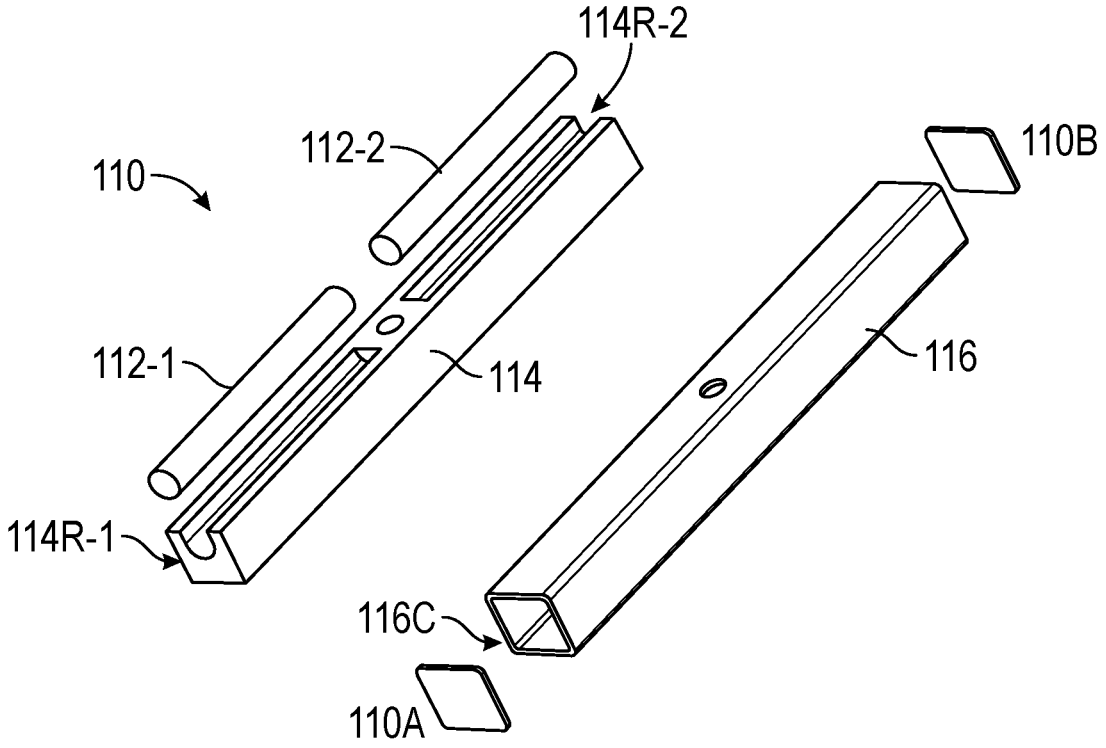
FIG. 6 shows a schematic exploded perspective view of an example throw bolt.

With particular reference to FIG. 6, an example throw bolt 110 may comprise two cutting barrier rods 112-1, 112-2; both may have the same shape and dimensions, and consist of the same material, such as hardened steel. In this example, the throw bolt 110 comprises a spacer block 114, provided with two grooved recesses 114R-1, 114R-2 having semi-circular transverse cross-sectional shape, for accommodating the respective cutting barriers 112-1, 112-2. The cutting barriers 112-1, 112-2 may be solid cylindrical rods, and each of the grooves 114R-1, 114R-2 may be semi-circular troughs. A central portion of the spacer block 114 may be disposed between the respective opposite ends of the cutting barriers 112-1, 112-2, spacing them apart longitudinally. In some variants of the example, the spacer block 114 may consist of (or comprise) steel or zinc alloy material.

In other versions of the example arrangement described with reference to FIG. 6, there may be more than two cutting barriers; for example, there may be three, four, five, six, or up to about ten cutting barrier rods. The cutting barrier rods may all have substantially the same size and/or shape, or they may have different sizes and/or shapes; they may comprise or consist of the same material, or different materials (or different grades of the same kind of material).

Figure 7:
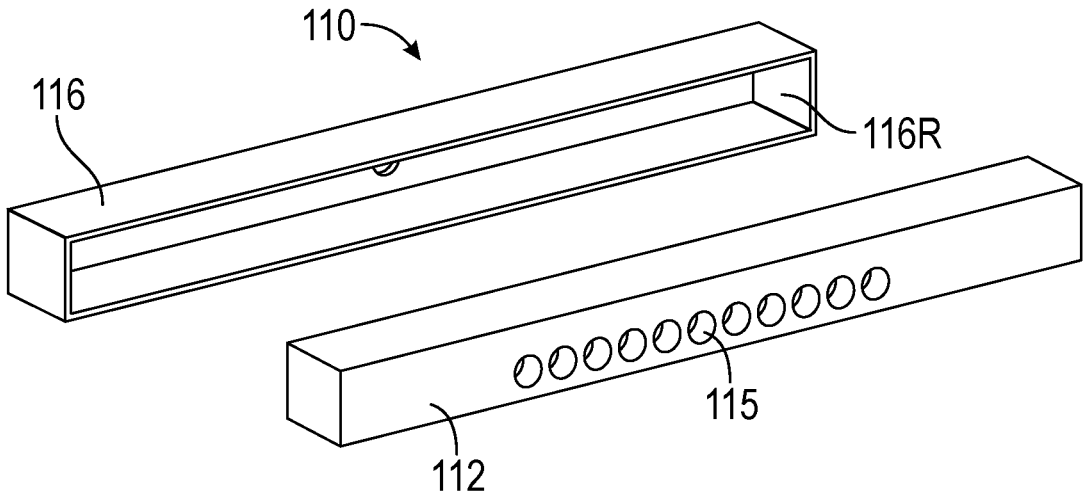
FIG. 7 shows a schematic exploded perspective view of part of an example throw bolt.

With particular reference to FIG. 7, an example throw bolt 110 may comprise a casing body 116 and a cutting barrier 116, in which the casing body 116 has a substantially square rectangular external shape and defines a cavity in the form of a square rectangular recess 116R, having an open side. The cutting barrier may be in the form of a hardened rod 112 consisting (apart from unavoidable impurities) of hardened steel, and may be substantially square rectangular in shape. In the illustrated example, the recess 116R extends between closed opposite ends of the casing body 116, and one of the sides of the casing body 116 can be open to receive the hardened rod 112. The shape and size of the recess 116R in the casing body 116 may be substantially the same as that of the hardened rod 112 (with sufficient tolerance for the hardened rod 112 to fit in the recess 116R. When the throw bolt 110 is assembled for use, the hardened rod 112 will be placed into the recess 116R, and a cover plate (not shown) can be placed over the opening of the recess 116R and welded to the casing body 116, to wholly enclose the hardened rod 112 within the bolt casing 116 (which will include the cover plate), apart from the relatively small hole 117 for accommodating a spring (not shown) that may bias the throw bolt against an internal side surface of the bolt holder in use. Once the throw bolt 110 has been assembled, a plurality of holes 115 may be bored through the cover plate and into the hardened rod 112, having size and shape for accommodating teeth of a drive mechanism coupled to a key mechanism, for moving the throw bolt 110 in use, between non-locking and locking positions.

Figure 8:
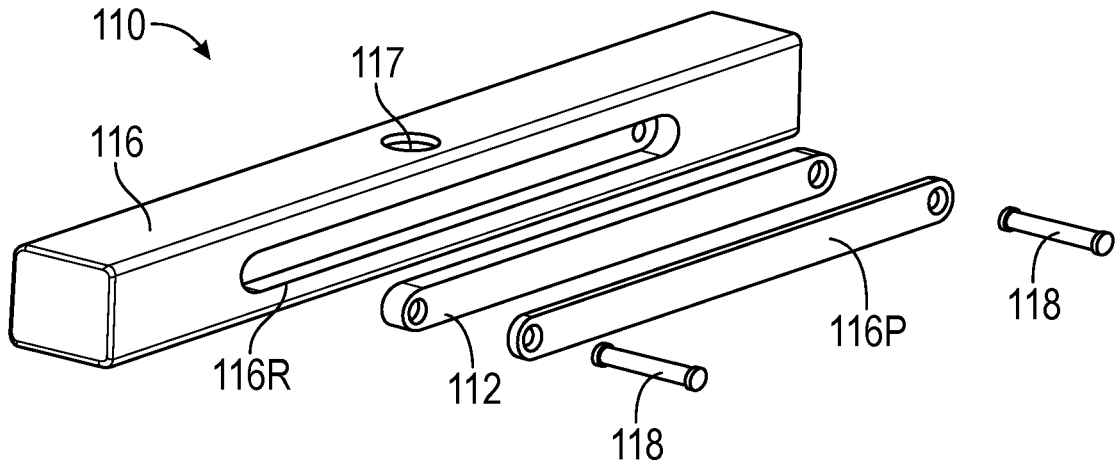
FIG. 8 shows a schematic exploded perspective view of an example throw bolt.

With reference to FIG. 8, an example throw bolt 110 for a lock assembly 100 may comprise a bolt casing 116, 116P, and a cutting barrier rod 112 that will be enclosed by the bolt casing 116, 116P and extend over at least a portion of the throw bolt 110 corresponding to the intermediate length 109 when installed for use. In the particular example illustrated, the bolt casing 116, 116P may comprise a casing block 116 and a cover plate 116P. The casing block 116 may have the general shape of a square or rectangular prism, and include a groove or recess 116R formed into a side thereof, for housing the cutting barrier rod 112. The recess 116R and the cutting barrier 112 may have the shape of an elongate plate, or strip, the opposite ends of which may be semi-circular. The cover plate 116P may have substantially the same shape as the cutting barrier 112 when viewed from a side, although its thickness may be less. The depth of the recess 116R exceeds the thickness of the cutting barrier 112 so that when the cutting barrier 112 is located within the recess 116R as in use, the cover plate 116P can be placed over the cutting barrier 112, with its outer surface being substantially flush with the external surface of the casing block 116. Thus, the cover plate 116P will entirely cover the cutting barrier 112 when the throw bolt 110 is assembled. Through-holes may be provided in the cutting barrier 112 and in the cover plate 116P for accommodating fastening pins (such as screws or bolts) 118 for fastening the cover plate 116P against the cutting barrier 112, thus securing it in place within the casing block 116. The tolerance of the fit between the cover plate 116P and the casing block 116 may be sufficient to prevent or reduce environmental water or other chemical agents from degrading the cutting barrier 112. The casing block 116 and cover plate 116P may consist of stainless steel.

Figure 9A:
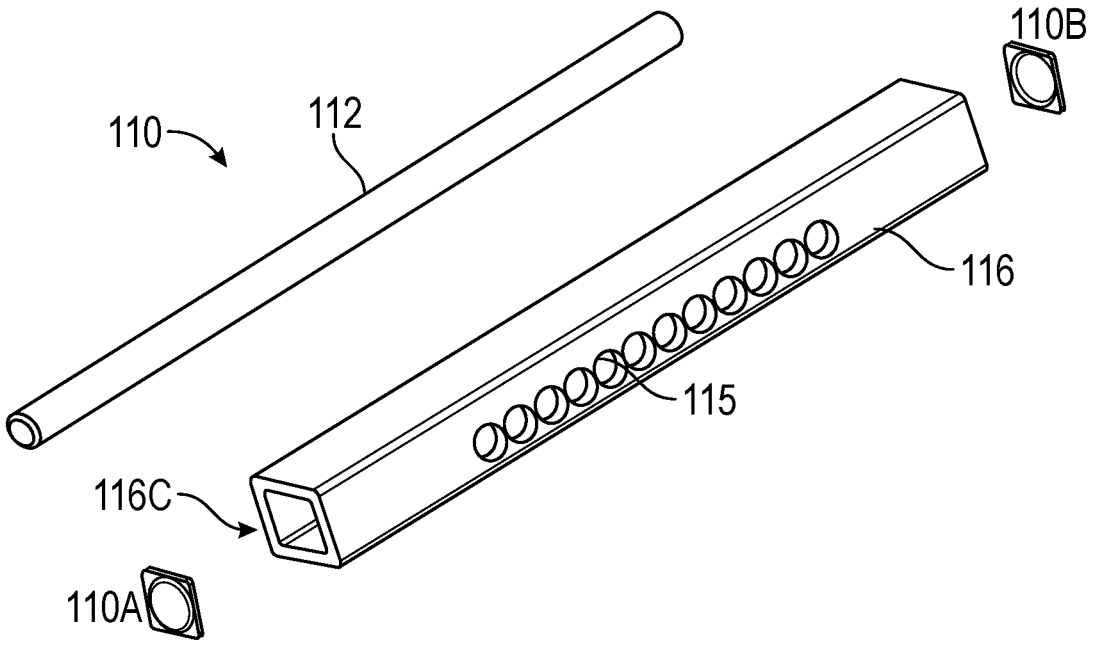
FIG. 9A shows a schematic exploded perspective view of an example throw bolt.
Figure 9B:
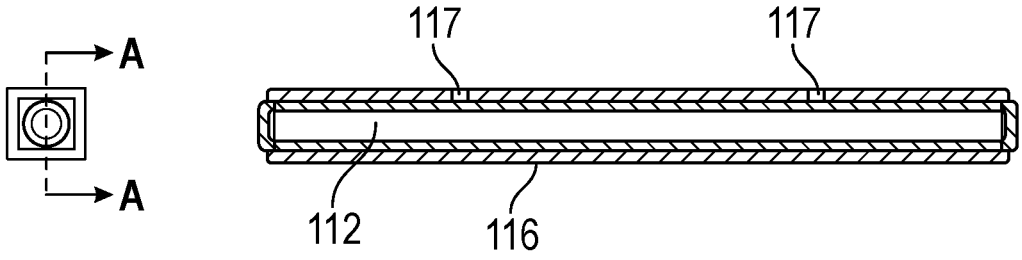
FIG. 9B shows a longitudinal cross-section view through the example bolt.
Figure 10A:
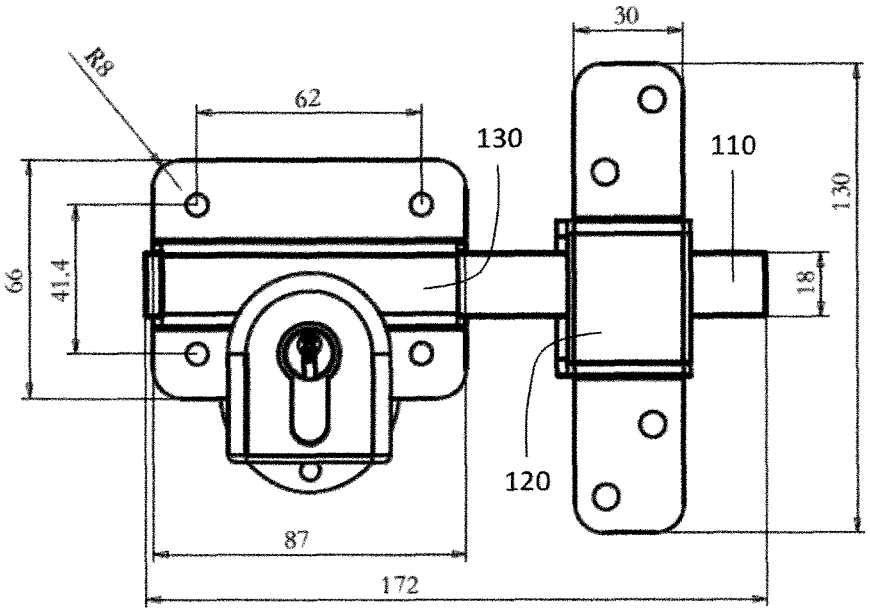
FIG. 10A to FIG. 10F show views of certain parts of an example throw lock assembly, including dimensions in units of millimetres and degrees; in particular.
Figure 10B:
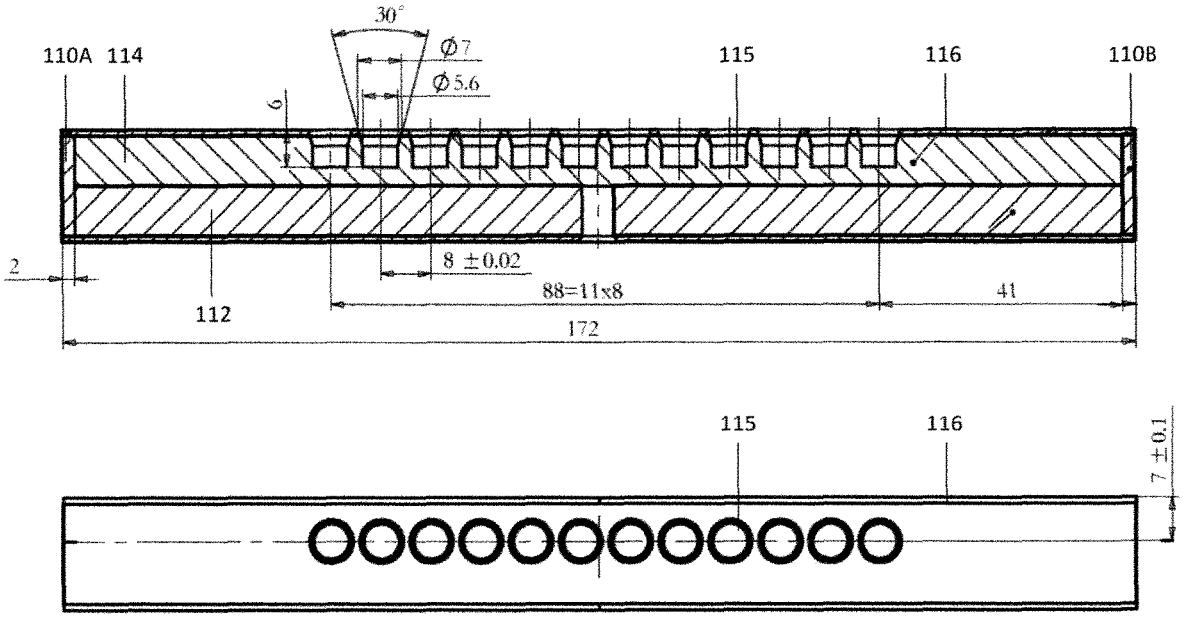
Figure 10C:
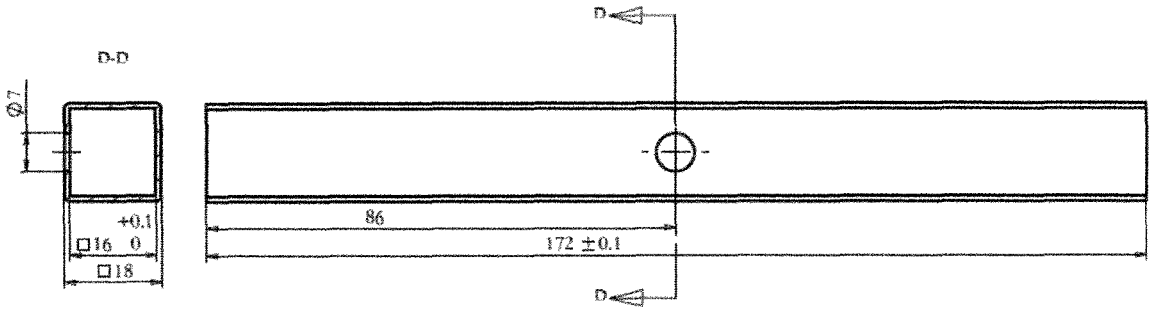
Figure 10D:
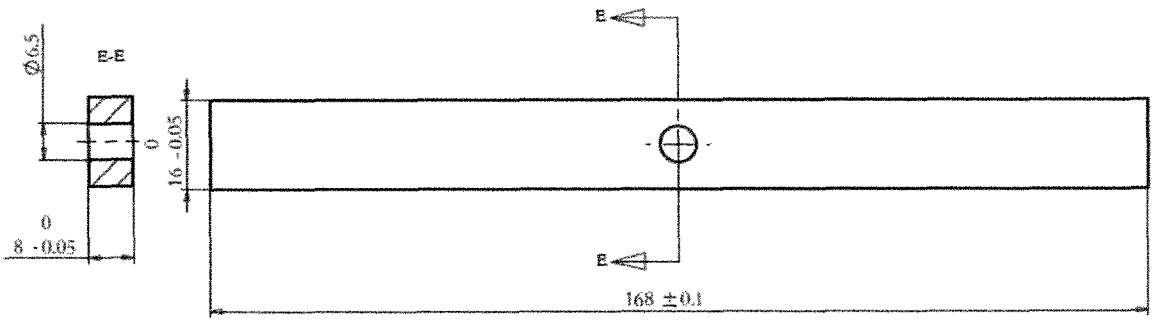
Figure 10E:
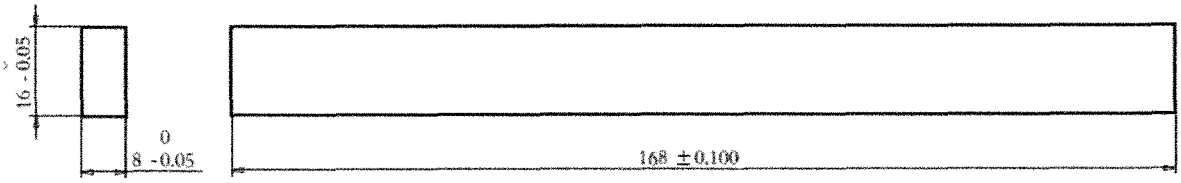
Figure 10F:
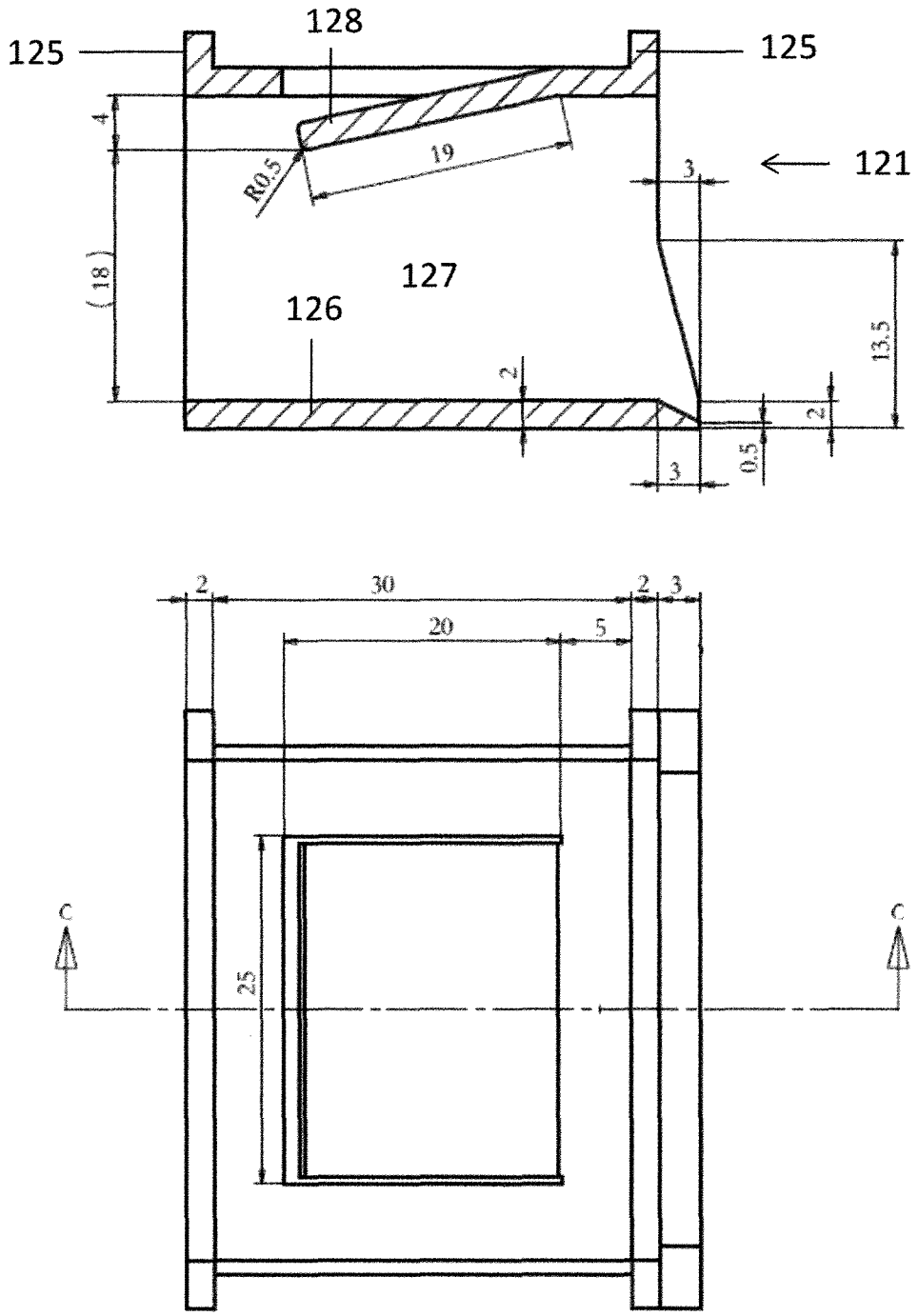

With reference to FIGS. 9A and 9B, the throw bolt 110 may comprise a cutting barrier 112 in the form of a solid cylindrical rod, the length of which may be substantially the same as the length of the cavity 116C of the casing tube 116. The end plates 110A, 110B and the respective ends of the cutting barrier may be cooperatively configured so that the cutting barrier can be held in place at its ends, by the respective end plates 111, 119. In examples like this, the cutting barrier 112 may be at least partly surrounded by a gap between its cylindrical surface and the surface of the cavity 116C. A plurality of blind holes 115 for the gear teeth 146 of the key mechanism may be formed into through the wall of the casing tube 116, arranged in a line.

Example disclosed bolts may good resistance to corrosion, since the sheath may define an external surface of the bolt having high corrosion resistance. Corrosion resistance can be measured by mean of a 'salt spray' (or 'salt fog') test, which is a standardise corrosion test method that can be used to measure the corrosion resistance of materials and surfaces, particularly but not exclusively metallic materials. The 'salt spray' test method involves exposing a surface to be tested to a corrosive environment for a certain period of time, after which the appearance of corrosion products (rust) is detected and quantified. The period of testing may depend on the corrosion resistance of material being teste. In general, the more corrosion resistant the surface is, the longer the period required before sufficient evidence of corrosion, such as rust, will appear. A standard for the corrosion resistance of building hardware is the European standard EN 1670. An internationally recognised standard salt spray test is ISO 9227 (a standard of the International Organization for Standardization). Other standards include ASTM B117 (a standard of the American Section of the International Association for Testing Materials™), JIS Z 2371 (a standard of the Japanese Industrial Standards) and ASTM G85. The Neutral Salt Spray (NSS) test may be used for testing steel-based materials, and involves using a test solution having a neutral pH of 6.5 to 7.2. The results can be expressed as a number of hours before the appearance of corrosion products (for example, a result may be expressed as 700 hours in NSS according to the ISO 9227 standard, and/or the EN 1670 standard).

The bolt casing may substantially enclose the whole of the cutting barrier; the bolt casing may prevent direct 'line-of-sight' access to the cutting barrier from the external environment, particularly direct access by environmental water such as rain. In some example arrangements, the throw bolt assembly may be configured such that when assembled as in use, the arrangement of the bolt casing and bolt holder, and the spacer member in some example assemblies, may substantially avoid line-of-sight direct access by rain or other potentially corrosive agents to the cutting barrier. For example, in some arrangements, one or more holes may be provided through the bolt casing (for example, for accommodating a biasing means such as a spring to bias the throw bolt within the bolt holder; or for accommodating gear teeth of a drive mechanism for moving the throw bolt between the non-locking and locking positions in use), and when the lock is assembled for use, the hole or holes may be covered or blocked by a member of the lock assembly, such as a part of the bolt holder, when the throw bolt is in any position from the non-locking to the locking positions (i.e. in any condition of normal use); and/or the hole or holes may terminate in a spacer member. In other words, if a hole or holes are provided through the bolt casing, another component of the throw lock assembly (for example a spacer member contained within the bolt casing, or a part of the bolt holder that external to the bolt casing) may provide a protective barrier between the cutting barrier and the external environment, to substantially prevent, or to reduce the risk or rate of corrosive or other chemical wear of the cutting barrier, which may potentially be caused by agents such as rain water from the external environment.

As used herein, 'gateway' and 'doorway' may be used interchangeably, and may refer to indoor or outdoor access systems for buildings, gardens, driveways or real estate generally, in residential, industrial, or agricultural constructions, for example. A gateway may comprise a moveable barrier that can be arranged to prevent or enable access through another barrier, which may be fixed, such as a wall, fence, or hedge. The moveable barrier may comprise or consist of door, gate, panel, leaf, stile or rail, for example, side of which may be coupled to the fixed barrier, a frame, door casing, or gate post, for example, by means of a sliding, rotating, or hinge mechanism. A lock assembly may be installed on the gateway to prevent or resist the moveable barrier from being moved relative to the fixed barrier, thus locking the door or gate.

The invention claimed is:

1. A throw lock assembly to lock a gateway, comprising:

a throw bolt, a bolt holder and a bolt keeper, and the throw bolt comprising a cutting barrier and a bolt casing to house the cutting barrier, the cutting barrier being harder than the bolt casing, and the bolt casing being more corrosion-resistant than the cutting barrier;

configured such that when arranged as in use, the throw bolt will be moveably coupled to the bolt holder, and is configured to be moved between a locking position and a non-locking position, in which in the locking position, a throw portion of the throw bolt will project from the bolt holder and extend into the bolt keeper, and in the non-locking position, the throw bolt will be retracted from the bolt keeper; and in which the throw portion of the throw bolt will include at least a portion of the cutting barrier, and an entirety of said portion of the cutting barrier in the throw portion will be shielded; in which the throw bolt comprises a spacer member housed within the bolt casing, arranged between the cutting barrier and a side wall of the bolt casing;

in which the spacer member comprises material having lower hardness than the cutting barrier; and the throw lock assembly comprising:

a drive mechanism to move the throw bolt in use between the non-locking and locking positions, responsive to an engagement member of the drive mechanism being inserted into a recess provided in the throw bolt and applying a force to the throw bolt; and in which the spacer member is configured such that the recess is formed through the side wall of the bolt casing and into the spacer member, without passing through the spacer member.

2. The throw lock assembly as claimed in claim 1, configured such that when assembled as in use, and the throw bolt is in the locking position, the cutting barrier will extend at least from an end of the bolt holder to at least a nearest end of the bolt keeper.

3. The throw lock assembly as claimed in claim 1, in which the cutting barrier comprises material having Rockwell C hardness of at least 55 HRc.

4. The throw lock assembly as claimed in claim 1, in which the cutting barrier comprises material consisting of one of the following: hardened steel, carbon steel, and cast iron.

5. The throw lock assembly as claimed in claim 1, in which the bolt casing comprises at least one of: a plurality of cooperatively configured casing members;

and stainless steel.

6. The throw lock assembly as claimed in claim 1, in which the bolt casing comprises:

a casing body and a cover plate; configured such that the casing body defines a cavity to accommodate the cutting barrier, and the cover plate joined to the casing body to enclose the cutting barrier within the cavity.

7. The throw lock assembly as claimed in claim 1, in which the bolt casing comprises one of the following:

a tubular body configured to contain the cutting barrier within a cavity extending between opposite ends of the tubular body; or a bar provided with a recess in a side thereof, configured to accommodate the cutting barrier within the recess.

8. The throw lock assembly as claimed in claim 1, in which the cutting barrier comprises a rod or bar.

9. The throw lock assembly as claimed in claim 1, in which the cutting barrier comprises a plurality of barrier members.

10. The throw lock assembly as claimed in claim 1, in which the spacer member comprises at least one of: material that is harder than that of the bolt casing, stainless steel, aluminium, and zinc alloy material.

11. The throw lock assembly as claimed in claim 1, in which the spacer member comprises a bar having with a recess configured to accommodate the cutting barrier.

12. The throw lock assembly as claimed in claim 1, in which the bolt casing defines an elongate cavity, in which the cutting barrier and the spacer member is enclosed, extending between opposite ends of the elongate cavity.

13. The throw lock assembly as claimed in claim 1, in which the bolt casing comprises a tubular body having opposite ends, to which respective end plates are attached, and the cutting barrier and the spacer member are in the form of rods that are housed within a cavity of the bolt casing and extend between ends of the cavity.

14. A throw bolt assembly of a throw lock assembly, the throw bolt assembly comprising:

a cutting barrier and a bolt casing to house the cutting barrier, the cutting barrier being harder than the bolt casing, and the bolt casing being more corrosion-resistant than the cutting barrier;

a throw portion of a throw bolt including at least a portion of the cutting barrier, and an entirety of said portion of the cutting barrier in the throw portion will be shielded; comprising:

a spacer member housed within the bolt casing, arranged between the cutting barrier and a side wall of the bolt casing; in which the spacer member comprises material having lower hardness than the cutting barrier; and the throw bolt assembly comprising:

a drive mechanism to move the throw bolt in use between non-locking and locking positions, responsive to an engagement member of the drive mechanism being inserted into a recess provided in the throw bolt and applying a force to the throw bolt; in which the spacer member is configured such that the recess is formed through the side wall of the bolt casing and into the spacer member, without passing through the spacer member; and in which the bolt casing comprises a tubular body having opposite ends, to which respective end plates are joined, and the cutting barrier and spacer member are in the form of rods that are housed within a cavity of the bolt casing and extend between ends of the cavity.

15. The throw bolt assembly as claimed in claim 14, in which the bolt casing defines an elongate cavity, in which the cutting barrier and the spacer member are enclosed, both extending between opposite ends of the cavity.

16. The throw bolt assembly as claimed in claim 14, in which the spacer member comprises a rod having a thickness of at least 5 mm and at most 14 mm, and a width of at least 5 mm and most 20 mm.

17. The throw bolt assembly as claimed in claim 14, provided unassembled.

18. The throw bolt assembly as claimed in claim 14, comprising a bolt holder to moveably accommodate the throw bolt, the bolt holder comprising:

a channel extending between proximal and distal ends, the channel configured such that the throw bolt is configured to slide coaxially within the channel, between a retracted position and a projecting position, in which when the throw bolt is in the projecting position, the throw portion of the throw bolt includes a distal end of the throw bolt and projects from the distal end of the channel; and when the throw bolt is in the retracted position, the distal end of the throw bolt will be relatively more proximate to the distal end of the channel than when the throw bolt is in the projecting position; and in which the bolt holder and the throw bolt are configured such that the throw portion of the throw bolt includes said portion of the cutting barrier, and the entirety of said portion of the cutting barrier in the throw portion is shielded.

19. A method of assembling a throw bolt assembly as claimed in claim 14, the method including:

assembling the throw bolt, and using a tool to remove material from the side wall of the bolt casing and from the spacer member adjacent the side wall, to form at least one recess into the spacer member, the recess not passing through the spacer member, the recess configured and arranged to accommodate an engagement member of a drive mechanism of the throw lock assembly, to engage and move the throw bolt in use between the non-locking and locking positions.

20. The method as claimed in claim 19, including boring a plurality of recesses into the spacer member, the recesses arranged in a row.

* * * * *